US010378526B2

(12) United States Patent
Barkley

(10) Patent No.: US 10,378,526 B2
(45) Date of Patent: Aug. 13, 2019

(54) METHOD AND APPARATUS FOR METERING AND VAPORIZING FLUIDS

(71) Applicant: Funai Electric Co., Ltd., Osaka (JP)

(72) Inventor: Lucas D. Barkley, Lexington, KY (US)

(73) Assignee: FUNAI ELECTRIC CO., LTD (JP)

( * ) Notice: Subject to any disclaimer, the term of this patent is extended or adjusted under 35 U.S.C. 154(b) by 457 days.

(21) Appl. No.: 14/976,036

(22) Filed: Dec. 21, 2015

(65) Prior Publication Data

US 2017/0175722 A1 Jun. 22, 2017

(51) Int. Cl.

| | |
|---|---|
| ***F04B 19/00*** | (2006.01) |
| ***F04B 19/24*** | (2006.01) |
| ***F04F 1/18*** | (2006.01) |
| ***F22B 1/28*** | (2006.01) |

(52) U.S. Cl.

CPC ..... *F04B 19/006* (2013.01); *F04B 19/24* (2013.01); *F04F 1/18* (2013.01); *F22B 1/282* (2013.01)

(58) Field of Classification Search

None

See application file for complete search history.

(56) References Cited

U.S. PATENT DOCUMENTS 4,099,916 A * 7/1978 Gardner ..... A61L 9/03 422/126
4,638,337 A 1/1987 Torpey et al.
5,093,894 A * 3/1992 Deevi ..... A24F 47/008 392/390
5,577,156 A * 11/1996 Costello ..... A01M 1/2077 219/541
5,874,974 A 2/1999 Courian et al.
5,946,012 A 8/1999 Courian et al.
6,227,640 B1 5/2001 Maze et al.
6,247,779 B1 6/2001 Nowell, Jr. et al.
6,533,951 B1 * 3/2003 Debar ..... F04B 19/24 137/147
7,284,839 B2 10/2007 Silverbook
7,367,334 B2 * 5/2008 Faison, Jr. ..... A61M 11/041 128/203.12
7,959,875 B2 * 6/2011 Zhou ..... B01L 3/5025 422/501
8,891,949 B2 * 11/2014 Hong ..... F04B 19/006 392/471
8,893,726 B2 11/2014 Hon
2001/0055242 A1 12/2001 Deshmukh et al.
2003/0175947 A1 * 9/2003 Liu ..... B01F 11/0071 435/288.5

(Continued)

*Primary Examiner* — Ibrahime A Abraham
*Assistant Examiner* — Gyounghyun Bae
(74) *Attorney, Agent, or Firm* — Luedeka Neely Group, PC

(57) ABSTRACT

A micro-fluidic device. The device includes a semiconductor substrate attached to a fluid supply source. The substrate contains at least one vaporization heater, one or more bubble pumps for feeding fluid from the fluid supply source to the at least one vaporization heater, a fluid supply inlet from the fluid supply source in fluid flow communication with each of the one or more bubble pumps, and a vapor outlet in vapor flow communication with the at least one vaporization heater. The one or more bubble pumps each have a fluid flow path selected from a linear path, a spiral path, a circuitous path, and a combination thereof from the supply inlet to the at least one vaporization heater.

19 Claims, 9 Drawing Sheets

(56) References Cited

U.S. PATENT DOCUMENTS

2004/0048116 A1* 3/2004 Ord ..... B01J 7/02 48/61
2004/0072278 A1* 4/2004 Chou ..... B01L 3/502761 435/29
2004/0112529 A1* 6/2004 Karlsson ..... B01J 19/0093 156/306.6
2005/0019026 A1* 1/2005 Wang ..... B01D 1/0082 392/389
2005/0063686 A1* 3/2005 Whittle ..... A61K 9/007 392/390
2005/0129529 A1* 6/2005 Cho ..... F04B 19/006 417/207
2005/0223783 A1* 10/2005 Spivak ..... F04B 19/24 73/54.14
2006/0047368 A1* 3/2006 Maharajh ..... F22B 1/28 700/283
2006/0051214 A1* 3/2006 Ussing ..... B01J 19/0093 417/51
2006/0193610 A1* 8/2006 Han ..... A61L 9/03 392/390
2008/0050102 A1* 2/2008 Lamers ..... A61L 9/03 392/386
2012/0007921 A1 1/2012 Govyadinov et al.
2012/0128549 A1* 5/2012 Zhou ..... B01L 3/5025 422/504
2013/0202278 A1* 8/2013 Hong ..... F04B 19/006 392/471
2013/0202453 A1* 8/2013 Hong ..... F04B 19/006 417/53
2013/0302884 A1* 11/2013 Fowler ..... C12Q 1/686 435/287.2
2014/0030800 A1* 1/2014 Moses ..... G01N 21/64 435/288.7
2014/0051161 A1* 2/2014 Bergstedt ..... B01L 7/525 435/303.1
2014/0060554 A1* 3/2014 Collett ..... H05B 3/265 131/328
2015/0182966 A1* 7/2015 Coursey ..... B01L 7/52 435/3
2016/0066621 A1* 3/2016 DePiano ..... A24F 47/008 131/328
2016/0150824 A1* 6/2016 Memari ..... A24F 15/12 131/329
2017/0360092 A1* 12/2017 Althorpe ..... A24F 47/008
2018/0021777 A1* 1/2018 Giri ..... B01L 3/502715
2018/0024155 A1* 1/2018 McGuinness ..... B01L 3/502715 422/507

* cited by examiner

METHOD AND APPARATUS FOR METERING AND VAPORIZING FLUIDS

TECHNICAL FIELD

The disclosure relates to apparatus and methods for metering and vaporizing fluids and in particular to a micro-fluidic device containing multiple micro-fluidic pumps and one or more vaporization heaters for vaporizing fluids provided by the micro-fluidic pumps.

BACKGROUND AND SUMMARY

Micro-fluidic devices are used to manipulate microscopic volumes of liquid inside micro-sized structures. Applications of such devices include precise liquid dispensing, drug delivery, point-of-care diagnostics, industrial and environmental monitoring and lab-on-a-chip devices. Lab-on-a-chip devices can provide advantages over conventional and non-micro-fluidic based techniques such as greater efficiency of chemical reagents, high speed analysis, high throughput, portability and low production costs per device. In many micro-fluidic applications such as liquid dispensing, point-of-care diagnostics or lab-on-a-chip, a role of the micro-fluidic pumps is to manipulate micro-volumes of liquids inside micro-channels.

Micro-fluidic pumps generally fall into two groups: mechanical pumps and non-mechanical pumps. Mechanical pumps use moving parts which exert pressure on a liquid to move a liquid from a supply source to a destination. Piezo-electric pumps, thermo-pneumatic pumps, and electro-osmotic pumps are included in this group. An electro-osmotic pump uses surface charges that spontaneously develop when a liquid contacts with a solid. When an electric field is applied, the space charges drag a body of the liquid in the direction of the electric field.

Another example of a non-mechanical pump is a pump exploiting thermal bubbles. By expanding and collapsing either a bubble with diffusers or bubbles in a coordinated way, a thermal bubble pump can transport liquid through a channel. Several types of thermal bubble pumps are known in the art.

Micro-fluidic bubble pumps are typically used to move micro quantities of fluid from a supply location to a destination so that a metered amount of liquid is delivered to the destination location. However, there is a need to deliver metered quantities of vaporized fluids from a supply location to a destination for various applications including vapor therapy, flavored e-cigarettes, chemical vapor reactions, and the like.

One problem with conventional bubble pumps is that the bubble pumps are limited by size and fluid flow constraints. Increasing the number of bubble pumps and the length of the bubble pumps increases the volume and pressure, respectively of liquid flowing out of the bubble pumps, and also increases the area required for dispensing liquids from the bubble pumps. For some applications, the size of the bubble pumps is critical. Accordingly, conventional bubble pumps may not be useful in a variety of applications that may require a small size with higher fluid pressures and/or increased fluid flow volumes.

In view of the foregoing, there is a need to provide a micro-fluidic vapor from a reduced size micro-fluidic ejection device. Accordingly, there is provided, in one embodiment, a micro-fluidic device. The device includes a semiconductor substrate attached to a fluid supply source. The substrate contains at least one vaporization heater, one or more bubble pumps for feeding fluid from the fluid supply source to the at least one vaporization heater, a fluid supply inlet from the fluid supply source in fluid flow communication with each of the one or more bubble pumps, and a vapor outlet in vapor flow communication with the at least one vaporization heater. The one or more bubble pumps each have a fluid flow path selected from a linear path, a spiral path, a circuitous path, and a combination thereof from the supply inlet to the at least one vaporization heater.

In another embodiment of the disclosure there is provided a method of vaporizing two or more fluids in micro-fluidic quantities. The method includes feeding two or more fluids to a micro-fluidic device that includes a semiconductor substrate attached to a fluid supply source. The substrate contains at least one vaporization heater, two or more bubble pumps for feeding fluid from the fluid supply source to the at least one vaporization heater, a fluid supply inlet from the fluid supply source in fluid flow communication with each of the two or more bubble pumps, and a vapor outlet in vapor flow communication with the at least one vaporization heater, wherein the two or more bubble pumps each have a fluid flow path selected from a linear path, a spiral path, a circuitous path, and a combination thereof from the supply inlet to the at least one vaporization heater. The two or more bubble pumps are energized to provide the two or more fluids to the at least one vaporization heater, the two or more fluids are vaporized with the at least one vaporization heater.

A further embodiment of the disclosure provides a method for reacting and vaporizing micro-fluidic quantities of two or more different fluids. The method includes providing a micro-fluidic device that contains a semiconductor substrate attached to two or more fluid supply sources. The substrate includes at least one vaporization heater, a bubble pump for feeding fluid from each of the two or more fluid supply sources to the at least one vaporization heater, a fluid supply inlet from each of the two or more fluid supply sources in fluid flow communication with each bubble pump, and a vapor outlet in vapor flow communication with the at least one vaporization heater, wherein each bubble pump has a fluid flow path selected from a linear path, a spiral path, a circuitous path, and a combination thereof from the supply inlet to the at least one vaporization heater. Each bubble pump is operated to provide the two or more different fluids to the at least one vaporization heater. The two or more fluids are reacted on the at least one vaporization heater to provide a reaction product, and the reaction product is vaporized with the at least one vaporization heater.

Accordingly, embodiments of the disclosure provide a compact micro-fluidic vaporizing device that may be used to mix and/or react and vaporize fluids for a variety of applications. The devices enable the pumping and vaporization of fluids at higher pressure than conventional devices and enable larger quantities of fluids to be vaporized without increasing the size of the device.

BRIEF DESCRIPTION OF THE DRAWINGS

Further advantages of the embodiments will become apparent by reference to the detailed description of exemplary embodiments when considered in conjunction with the drawings, wherein like reference characters designate like or similar elements throughout the several drawings as follows.

DETAILED DESCRIPTION OF EXEMPLARY EMBODIMENTS

Micro-fluid bubble pumps are miniature electronic devices that can be used to eject fluids onto surfaces. In the case of the present disclosure, the bubble pumps are used to provide pre-determined amounts of one or more fluids to at least one vaporization device in order to mix and/or react the fluids and provide a vaporized fluid. Vaporized fluids have application in a variety of devices including, but not limited to, vapor therapy, air fresheners, drug delivery, micro-scale laboratories on chips, e-cigarettes, and the like. In some embodiments, two or more different fluids are provided to a single vaporization device. In other embodiments, two or more fluids are provided to different vaporization devices. In yet other embodiments, a predetermined volume of a single fluid is provided to one or more vaporization devices. Increasing the volume or pressure of fluid or the use of two or more different fluids in a bubble pump and vaporization device typically requires an increase in the size of the device. However, embodiments of the disclosure may provide a unique bubble pump and vaporization device arrangement that enables minimization of the size of the device.

Pumping of fluids to a vaporization device using a micro-fluid bubble pump is achieved by supercritical heating of a fluid. While the supercritical temperature of a fluid is higher than the boiling point, only a thin layer of the liquid is involved in forming thermal vapor bubbles. For example, while the supercritical temperature of water is about 300° C., the thermal bubbles can be formed by heating less than 0.5 μm thick layer of water on top of a heater to the supercritical temperature for a few micro-seconds. Accordingly, less than one percent of the liquid may experience the supercritical temperature. The supercritical temperature of the fluid lasts for a few micro-seconds, hence the temperature of the bulk of the fluid will remain at an initial temperature of the fluid in the bubble pump. The thermal vapor bubble thus formed provides a high initial pressure of around 100 Atm. The pressure of the vapor bubble may be used to move fluid through the bubble pump from an inlet end thereof to a terminal end thereof.

Figure 1:
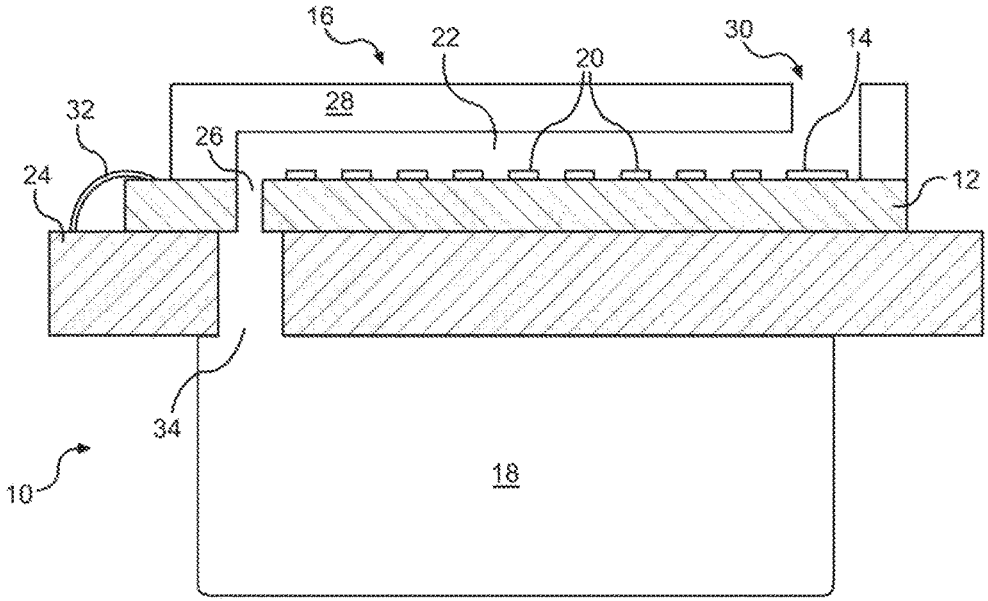
FIG. 1 is a cross-sectional schematic view, not to scale, of a bubble pump and vaporization device and fluid container according to an embodiment of the disclosure.
Figure 2:
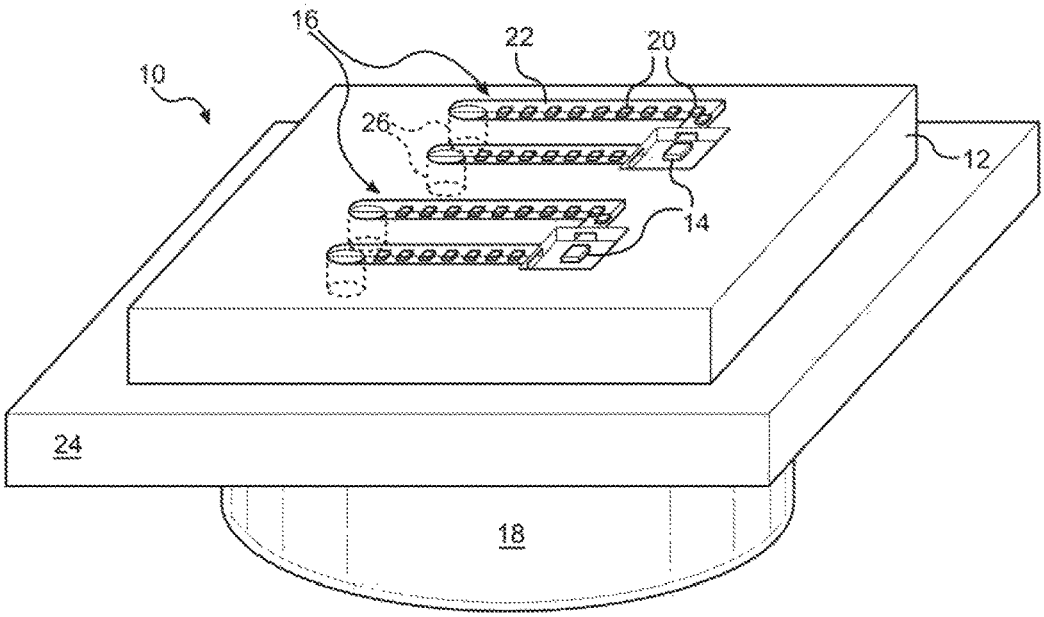
FIG. 2 is a perspective view, not to scale, of a substrate with a top cover plate removed and a fluid container according to an embodiment of the disclosure.

FIGS. 1 and 2 illustrate one embodiment of a micro-fluidic device 10 according to an embodiment of the disclosure. The device 10 includes a semiconductor substrate 12 containing at least one vaporization heater 14 and one or more bubble pumps 16 for feeding fluid from a supply source 18 to the vaporization heater 14. The substrate 12 is typically silicon which enables formation of the bubble pumps and associated logic circuits thereon. The bubble pumps 16 include a plurality of resistor heaters 20 that are attached to the substrate 12 in a channel 22 that is formed in the substrate 12 or in a cover plate 28 or partially in the substrate 12 and in the cover plate 28. The cover plate 28 may be made of silicon or a polymeric film such as polyimide. The resistor heaters 20 and vaporization heaters 14 may be made of TaAlN, TaAl or other thin film resistor material. The preferred material for the resistor heaters 20 and vaporization heaters 14 is TaAlN deposited that may be deposited on the substrate 12 by sputtering. The bubble pumps 16 are activated, as described in more detail below. Fluid is provided from the fluid supply source 18 to the bubble pumps 16 by use of a fluid inlet via 26 that is etched through the substrate 12. The fluid supply source 18 is attached to a side of the substrate 12 opposite the resistor heaters 20 and vaporization heater 14, or as shown in FIGS. 1 and 2 to a PCB board 24 to which the substrate 12 is attached. Having the fluid supply source attached on a side of the substrate 12 opposite the resistor heaters 20 and vaporization heater 14 enables a more compact design for the vaporizing device 10.

In operation, a voltage pulse is applied to each of the heater resistors 20 in sequence generating thermal bubbles in a predetermined manner. For example, every resistor heater 20 can form a bubble from the left to the right in the channel 22 in sequence to push fluid in the same direction through the channel 22 from the fluid inlet via 26 to the vaporization heater 14. The voltage pulses may be continuous, in sequence from left to right, or may be reversed to move liquid from right to left in the channel 22. The direction of flow of fluid through the bubble pump 16 is determined by the sequence of resistor heaters 20 that are activated. In order to move liquid from one end of the channel 22 to the other end, after firing a resistor heater 20, the resistor heater is allowed to cool down before the next firing sequence in order to prevent overheating and boiling of liquid on the resistor heater 20.

The channel 22 together with a cover layer 28 form a closed channel for moving fluid therethrough. Unlike traditional thermal ink jet nozzle plates used for ejecting ink, the cover layer 28 here has no nozzle holes through which to eject fluid. Rather, the cover layer 28 retains the fluid in the channel 22 as bounded by walls of the channel and the cover layer 28. In this way, fluid is moved through the channel 22 according to a path of travel on from the fluid inlet via 26 to the vaporization heater 14 as defined by the channel 22.

Fluid is only introduced into the channel 22 from a fluid inlet via 26 and the vaporized fluid exits from the channel through vapor outlet 30 in the cover layer 28. The size of the channel is determined by the fluid being pumped, the size of the resistor heaters 20 used to move the fluid and the vaporization rate of the fluid.

Figure 3:
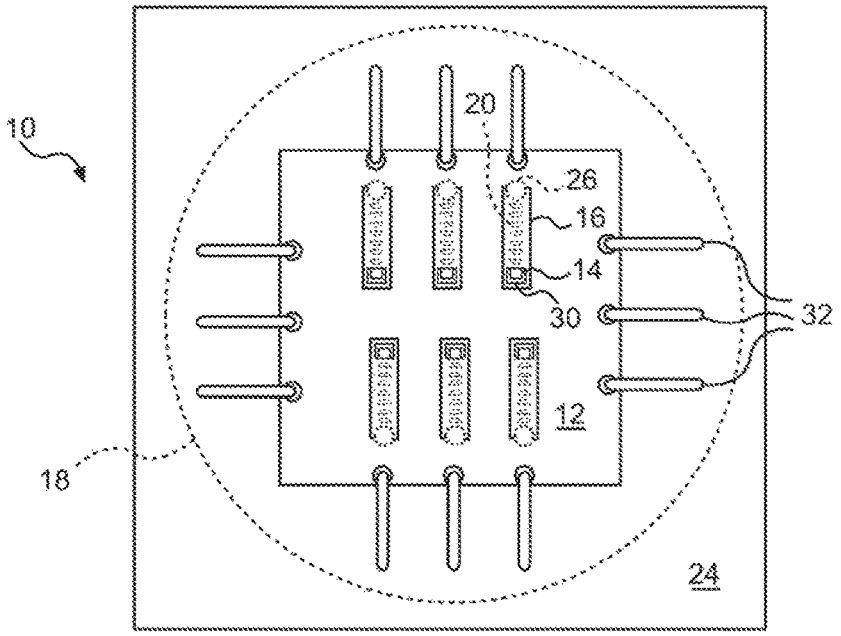
FIG. 3 is a schematic plan view of a substrate containing multiple bubble pumps and vaporization devices according to an embodiment of the disclosure.

In another embodiment, shown in FIG. 3, multiple bubble pumps 16 and vaporization devices 14 are shown on a substrate 12 that is attached to and electrically connected to the PCB board 24 by means of wire bonding 32. Fluid inlet vias 26, as described above, are etched through the substrate 12 as before to supply fluid from the supply source 18 through a fluid outlet 34 (FIG. 1) through the PCB board 24 to the bubble pumps 16.

Figure 4:
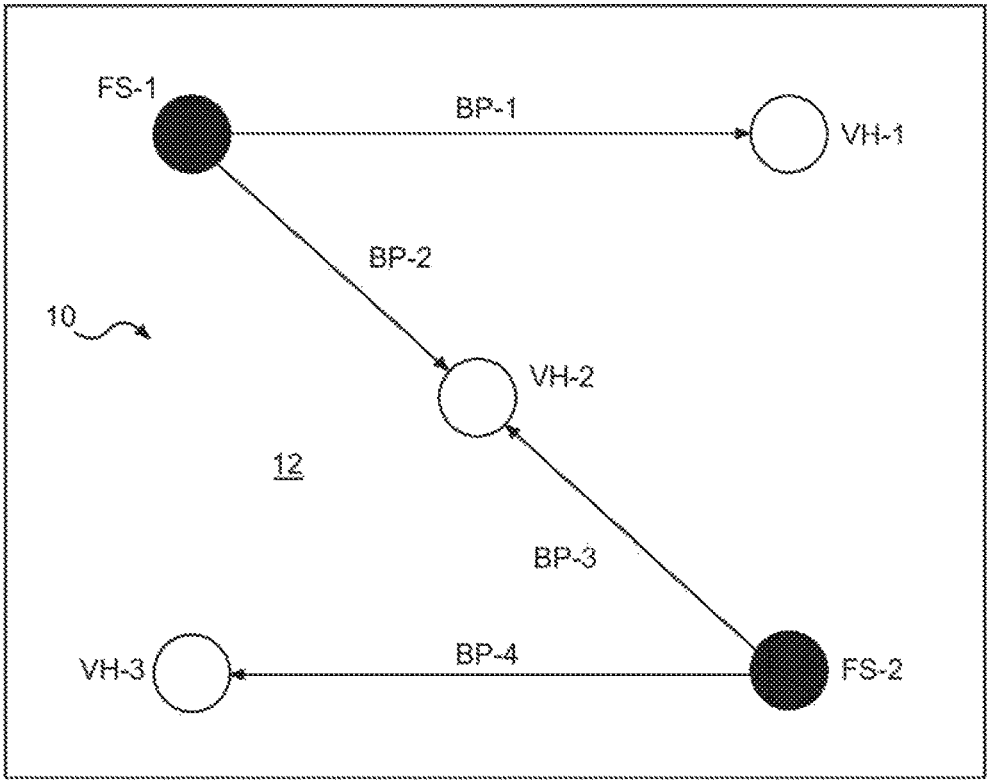
FIG. 4 is a schematic drawing, not to scale, of multiple bubble pumps for feeding fluid to a vaporization device according to one embodiment of the disclosure.
Figure 5:
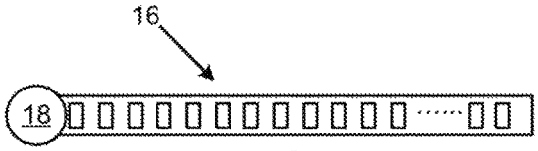
FIG. 5 is a schematic illustration of a bubble pump structure having a single unit size.

FIG. 4 is a schematic illustration of the operation of a micro-fluidic device 10 on a substrate 12 attached to fluid supplies FS-1 and FS-2. The device 10 includes bubble pumps BP-1 to BP-4 and vaporization heaters VH-1 to VH-3. As shown FS-1 provides fluid to bubble pumps BP-1 and BP-2 for vaporization by vaporization heaters VH-1 and VH-2. Likewise, FS-2 provides fluid to bubble pumps BP-3 and BP-4 for vaporization by vaporization heaters VH-2 and VH-3. The micro-fluidic device 10 may be operated to provide fluid to one or more of the vaporization heaters VH-1 to VH-3 or may be operated to provide different fluids from fluid supplies FS-1 and FS-2 to vaporization heater VH-2 or any combination thereof. While only three vaporization heaters VH-1 to VH-3 are shown, it is contemplated to many more bubble pumps and vaporization heaters may be provided on a substrate 12 and multiple modes of operation may be used. Accordingly, the micro-fluidic device 10 of FIG. 4 may be operated to mix multiple fluids for vaporization or to mix and react multiple fluids as well as to vaporize individual fluids and mixed fluids. The vaporized fluids may be channeled to a single vapor outlet 30 if desired or to multiple vapor outlets 30.

In order to obtain a predetermined pumping rate of fluid with bubble pumps 16, with resistor heaters 20 of a predetermined size, the geometric relationships among the resistor heaters 20 and between adjacent heaters 20 and the channel 22 are important. For example, a ratio of the width of the channel (CW) to the length of the heaters (HL) may be in the range of 1.0 to 2.0. The spacing (HD) between two adjacent heaters may be in the range of 1.5 HW to 4 HW. For pumps out of these ranges, the pumping rates may be significantly reduced. For example, a pump with the spacing (HD) larger than 4 HW showed a low pumping rate of less than 0.1 μl/min at the condition whereas a pump with the spacing of 1.5 HW showed over 10 μl/min. The preferred ratio of CW to HL is 1.72 and the preferred spacing (HD) is 56 μm.

The size of a resistor heaters 20 determines the required energy per fire. For the pumps disclosed in herein, the length and width of each resistor heater 20 is in the range of 10 to 100 μm. The preferred length and width are 29 μm and 17 μm, respectively. In some embodiments, the resistor heater 20 lengths and widths may have dissimilar dimensions in a common channel 22. The resistor heaters 20 may alternatively have asymmetric spacing between adjacent heaters 20.

According to an embodiment of the disclosure, the pressure of fluid in the bubble pumps 16 may be increased, if required, by lengthening the bubble pump channels and increasing the number of resistor heaters in the channel. However, as stated above, since there is a preferred spacing between heater resistors in a channel for effective pumping, the only suitable alternative is to lengthen the channels. Lengthening the channels typically requires additional substrate area which may not be practical for the use of micro-fluidic devices in small structures such as e-cigarettes. While the size of the bubble pumps may also be reduced to reduce the size of the substrate, this solution may also be impractical since it reduces the amount of fluid that can be delivered to the vaporization heater.

Figure 6:
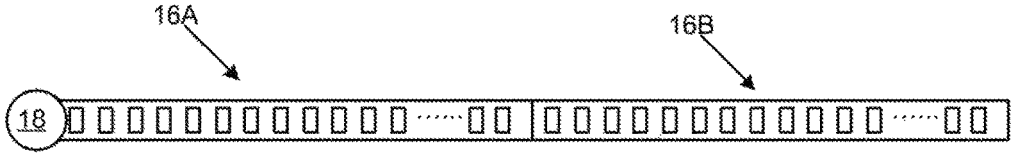
FIG. 6 is a schematic illustration of a linear bubble pump having a size of two single units.
Figure 7:
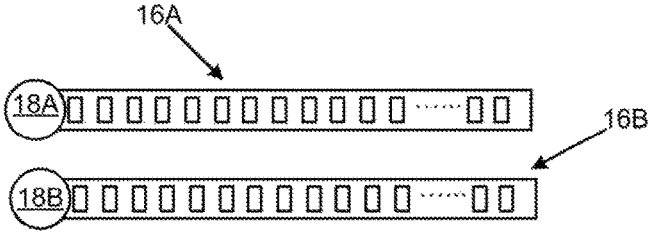
FIG. 7 is a schematic illustration of parallel bubble pumps each having a size of a single unit.
Figure 8:
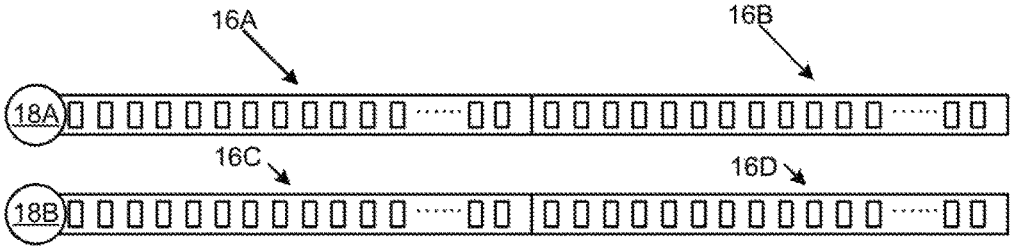
FIG. 8 is a schematic illustration of parallel bubble pumps each having a size of two single units.

For example, with reference to FIGS. 5-8, a single bubble pump 16 having a unit size of one for pumping fluid from fluid source 18 is illustrated. If bubble pump 16 is taken as the smallest that is operable, then multiple bubble pumps 16 of this size may be used to achieve different desired pumping characteristics wherein P is pressure and F is flow of bubble pump 16. Pump pressure P is additive when the pumps 16A and 16B are attached in series as shown in FIG. 6, while flow F is additive when the pumps 16A and 16B are in parallel as shown in FIG. 7. In FIG. 6 the pump pressure is 2P and the flow is F and in FIG. 7 the pump pressure is P and the flow is 2F. In FIG. 8, bubble pump units 16A and 16B are in series and are provided in parallel to bubble pumps 16C and 16D. Accordingly, the pressure provided by the arrangement in FIG. 7 is 2P and the flow is 2F. Other combinations and numbers of bubble pumps may be used to achieve different pumping characteristic.

Figure 9:
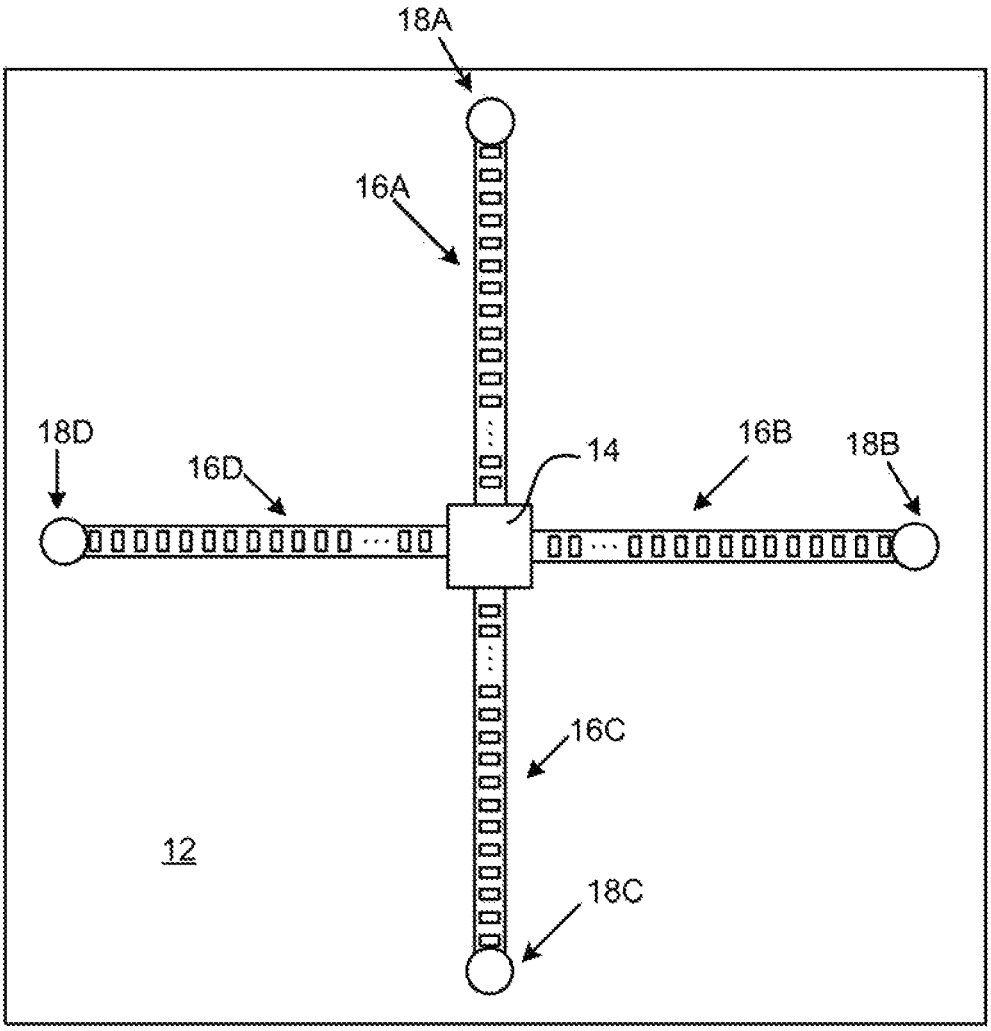
FIG. 9 is a schematic illustration of a substrate containing four single unit bubble pumps.
Figure 10:
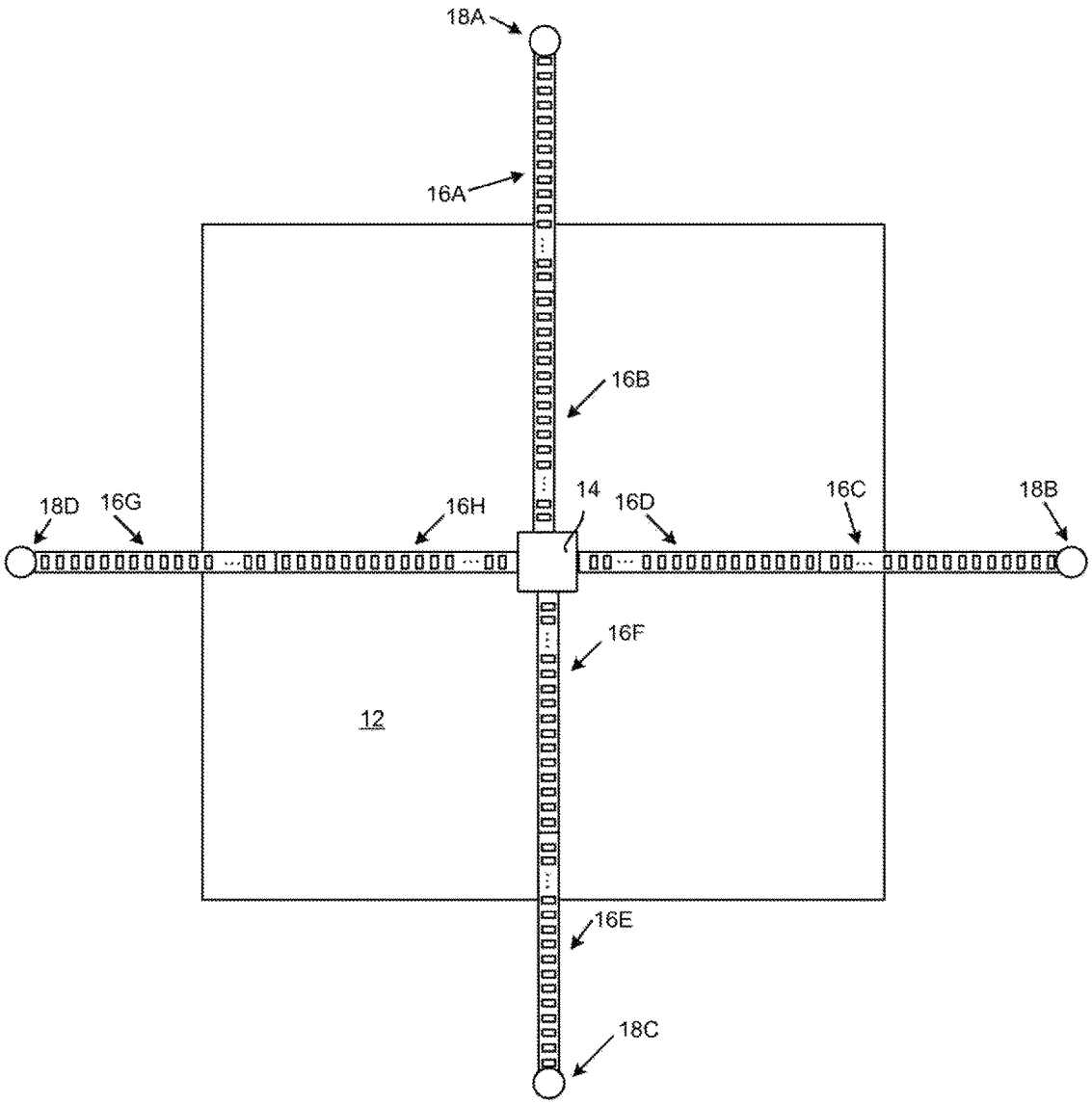
FIGS. 10 and 11 are a schematic illustrations of substrates that are too small for four double unit bubble pumps.
Figure 11:
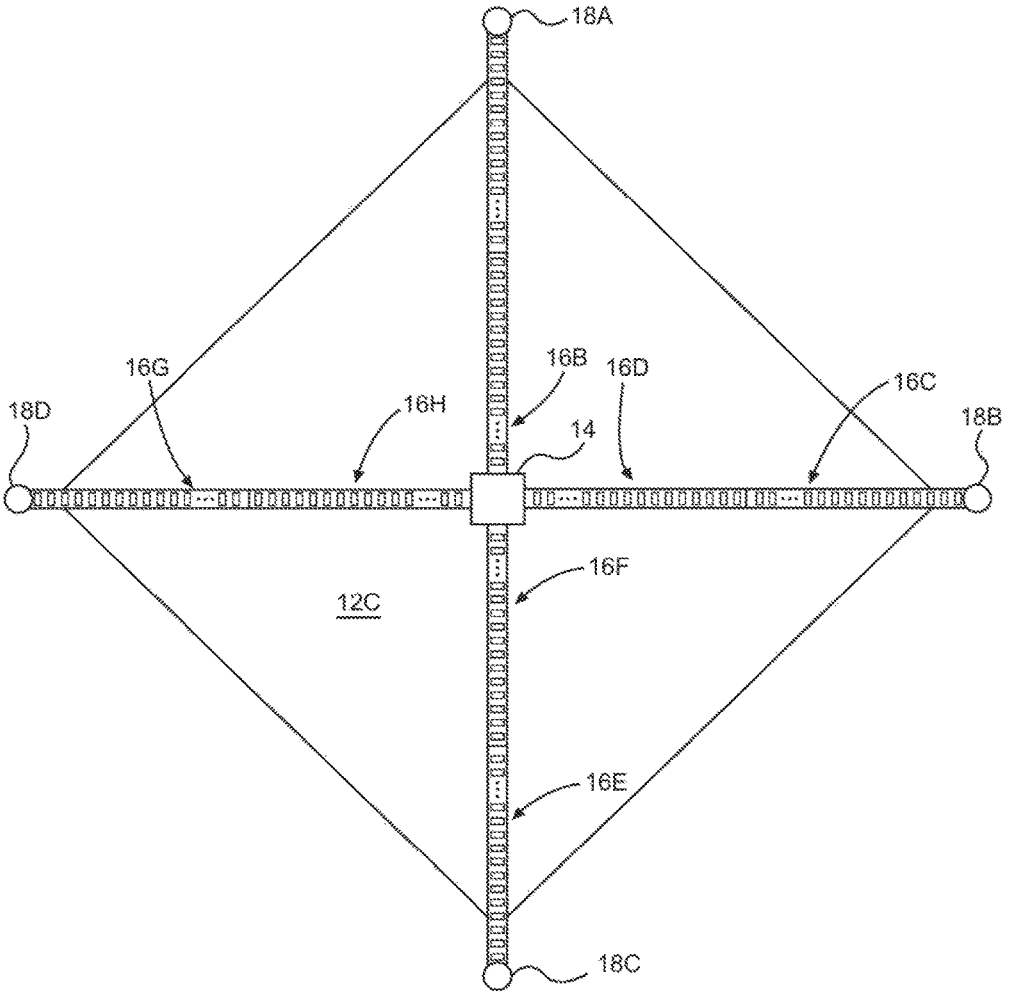
Figure 12:
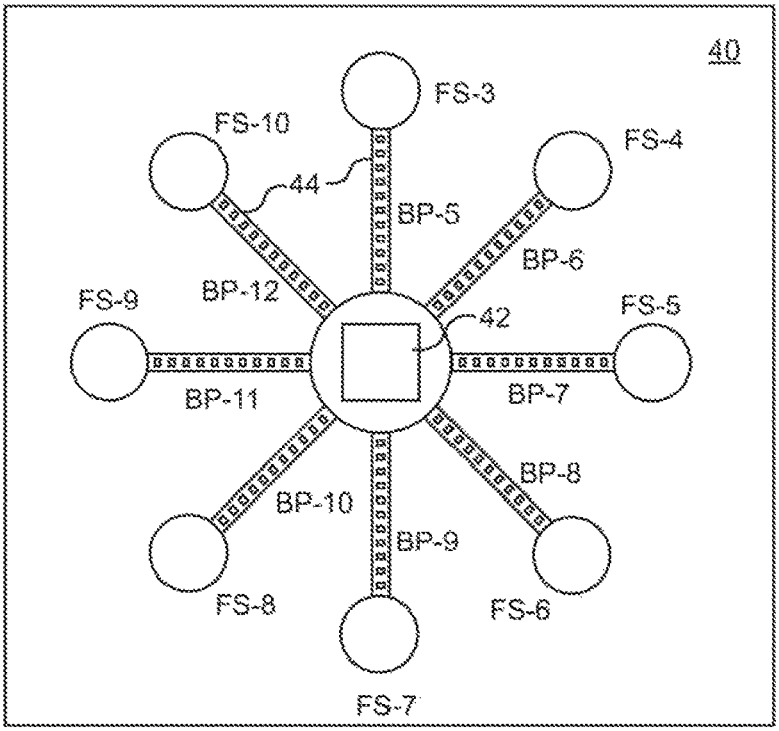
FIG. 12 is a schematic drawing, not to scale of, multiple bubble pumps for feeding fluid to a vaporization device according to a first embodiment of the disclosure.

With regard to FIGS. 9-12, the bubble pumps are arranged along a line of symmetry with respect to the vaporization heaters. In FIG. 9 bubble pumps 16A-16D providing fluid from supply sources 18A to 18D to vaporization heater 14 are provided on a substrate 12 of a particular size. In this case, the pumps 16A-16D provide a flow F at a pressure P to the vaporization heater 14. The unit size pumps 16A-16D fit on the substrate 12. However, if higher pressure is required as shown in FIGS. 10 and 11, bubble pumps 16A-16H of two-unit size will not fit on the substrate 12 regardless of the orientation of the substrate relative to the pumps.

Accordingly, alternative embodiments for the arrangement of multiple bubble pumps and vaporization heater(s) on a substrate are illustrated schematically in FIGS. 12-16. Each of the FIGS. 12-16 shows a single vaporization heater for multiple bubble pumps (BP). As described above with reference to FIG. 4, multiple vaporization heaters may also be used with any of the embodiments shown in FIGS. 12-16. FIGS. 12-16 merely illustrate possible arrangements of bubble pumps with respect to a vaporization heater whereby the volume and pressure of liquid supplied and vaporized is may be increased for a given size of substrate selected. For example, in FIG. 12, multiple bubble pumps BP-5 to BP-12 of unit size one are provided on a substrate 40 in fluid flow communication fluid supply sources FS-3 to FS-10, respectively which may provide the same fluid or two or more different fluids to the bubble pumps BP-5 to BP-12. The bubble pumps BP-5 to BP-12 contain linear channels 44 arranged in a radial pattern around a central vaporization heater 42. More or fewer bubble pumps (BP) may be used depending on the volume of fluid to be vaporized. In this case, the pressure provided by the bubble pumps is P and the total flow is 8F. The radial orientation of linear bubble pumps around a central vaporization heater 42 may require a smaller substrate than a substrate containing fewer bubble pumps in a side by side relationship to one another.

Figure 13:
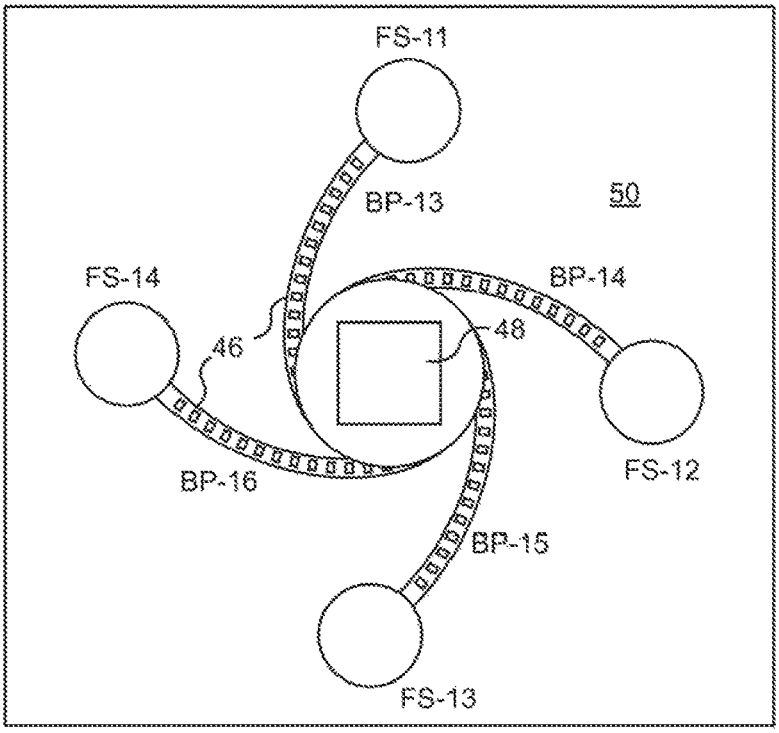
FIG. 13 is a schematic drawing, not to scale of, multiple bubble pumps for feeding fluid to a vaporization device according to a second embodiment of the disclosure.
Figure 14:
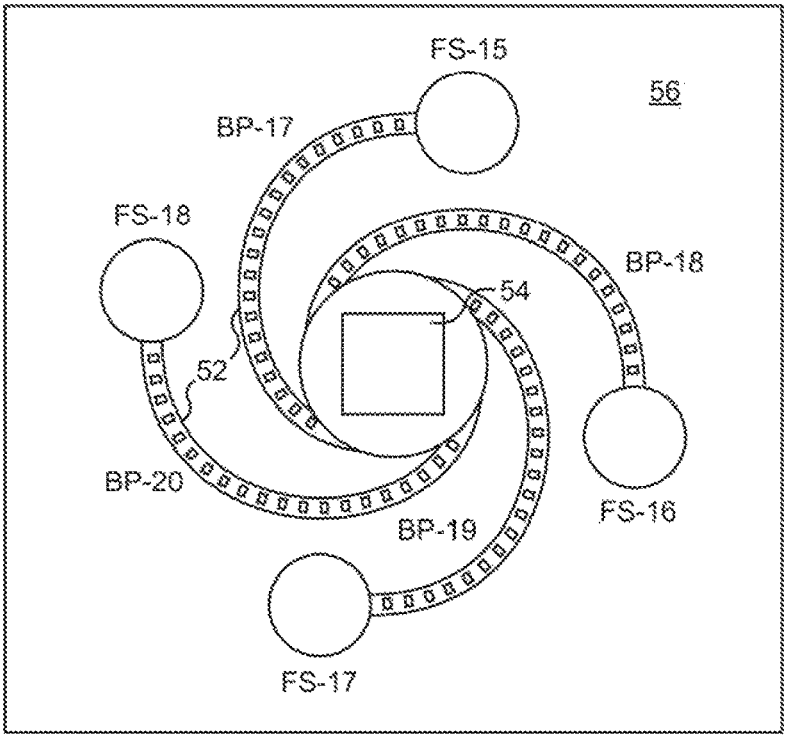
FIG. 14 is a schematic drawing, not to scale of, multiple bubble pumps for feeding fluid to a vaporization device according to a third embodiment of the disclosure.
Figure 15:
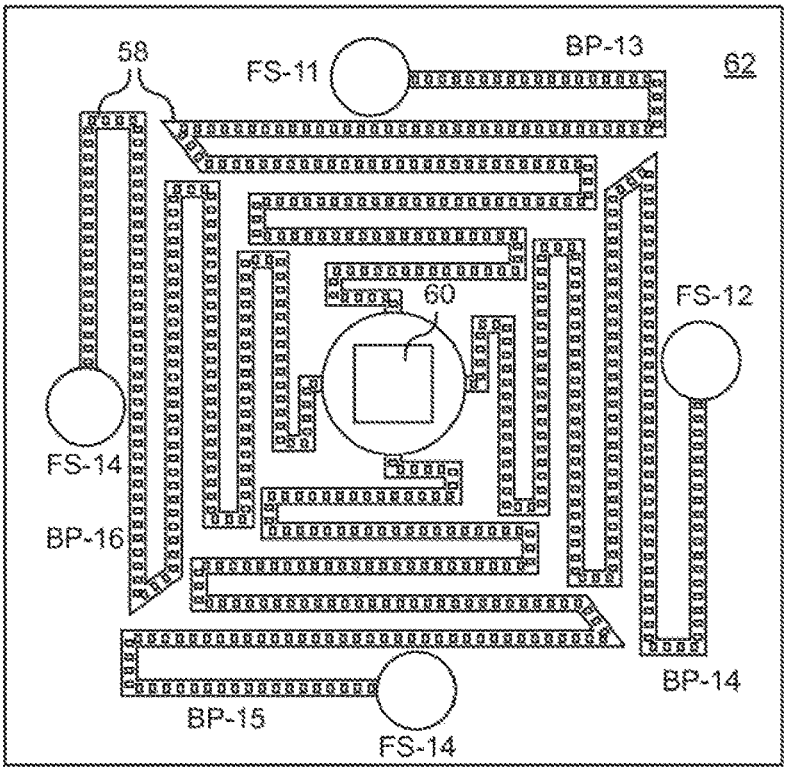
FIG. 15 is a schematic drawing not to scale of an alternative feed arrangement for bubble pumps for feeding fluid to a vaporization device according to a fourth embodiment of the disclosure.

In FIGS. 13-15, the bubble pumps have points of symmetry with respect to the vaporization heaters rather lines of symmetry as in FIGS. 9-12. In order to further reduce the size of substrate or increase the pressure and/or flow of fluid to a vaporization heater, arcuate channels 46 (FIG. 13) rather than linear channels may be used for the bubble pumps (BP), wherein the arcuate channels are arranged in a radial or spiral pattern with respect to a vaporization heater 48 on substrate 50. Fluid is provided from fluid supply sources (FS) for each bubble pump as shown in FIG. 13. According to this embodiment, the channels 46 are the same length or longer than the channels 44 illustrated in FIG. 12, however, because the channels 46 have an arcuate configuration, the substrate 50 may be made smaller or the pumps BP may be longer than the linear arrangement of bubble pumps on substrate 40 shown in FIG. 12. As with the previous embodiment, the number of bubble pumps (BP) may be increased or decreased, and there may be one or more vaporization heaters 48 on the substrate 50.

A further embodiment is illustrated in FIG. 14 which is similar to FIG. 13 with the exception that the channels 52 are longer and the arcuate shape of the channels 52 are a greater portion of a circle so that the fluid supply sources (FS) for the bubble pumps (BP) are physically closer to the vaporization heater 54 than the fluid supplies for the bubble pumps shown in FIG. 13 yet the channel lengths are greater than the channel lengths in FIG. 13. The shape of the arcuate channels in FIG. 14 may further reduce the size of substrate 56 needed for the same number of bubble pumps and vaporization device(s) or increase the pressure P compared to the embodiments shown in FIGS. 12 and 13. In FIGS. 13 and 14, the radius r of the spiral flow channels 46 and 52 may range from theta/0.05 pi to theta/5 pi, wherein theta is the angle and the length L of the channels 46 and 52 may range from 1.0*A to 8*A wherein A is the unit length of channel 16 according to FIG. 5. For example, in FIG. 13, the radius r is theta/0.5*pi and the length L is 1.3227*A, while in FIG. 14, the radius r is theta/pi and the length L is 1.9442*A.

Figure 16:
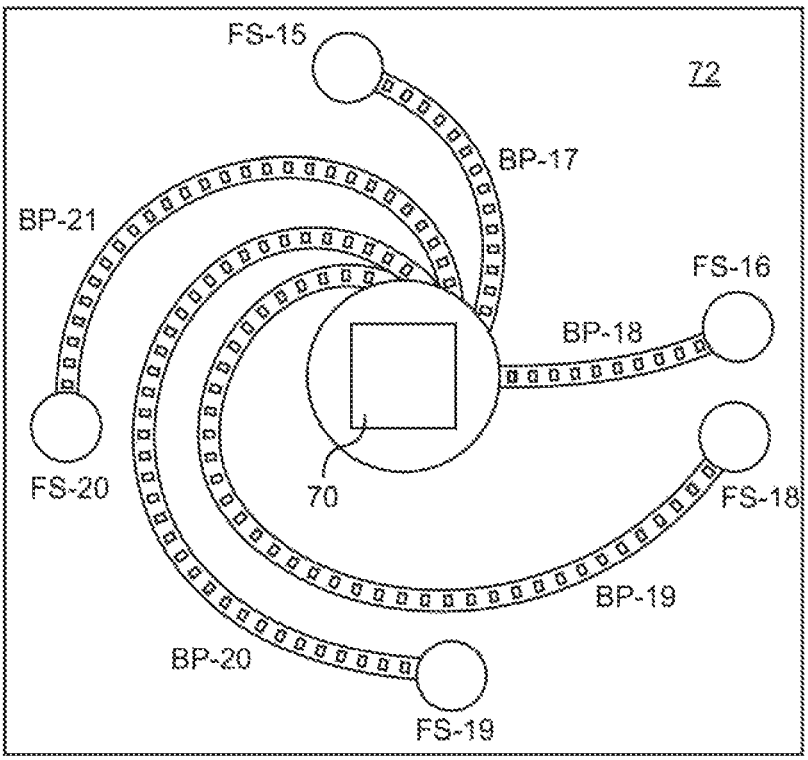
FIG. 16 is a schematic drawing not to scale of an alternative feed arrangement for bubble pumps for feeding fluid to a vaporization device according to a fifth embodiment of the disclosure.

Yet another embodiment of the disclosure provides bubble pumps (BP) having channels 58 with circuitous paths from the fluid supply (FS) to the vaporization heater 60 as shown in FIG. 15. Such circuitous channel paths may be used to maximize the pressure of fluid provided by the bubble pumps (BP) by increasing the length of the bubble pumps to X*A, where X is an integer from 2 to 6 or more while at the same time minimizing the size of substrate 62 needed for high pressure bubble pumps (BP). It will be appreciated that a combination of bubble pump arrangements and channel designs illustrated in FIGS. 12-15 may be used for a single micro-fluidic device according to the disclosure. Likewise, as shown in FIG. 16, bubble pumps BP-17 to BP-21 may be provided on substrate 72 with different radius' r and different lengths L. The arrangement shown in FIG. 16 enables the pumping of different amounts of multiple fluids to the vaporization heater 70, wherein each fluid may a different flow property or fluid characteristic. FIG. 16 also enables more precise control of the flow volume and/or pressure of fluid flowing to the vaporization heater 70 by selecting a bubble pump that is proper for the fluid.

With reference again to FIGS. 1 and 2, conventional logic circuits (not shown) on the substrate 12 may be used to control and drive the micro-fluidic pump(s). The logic circuits may be formed on the silicon substrate 12 by conventional silicon processing techniques. The logic circuits may include AND gates, latches, shift registers, power transistors or the like. A typical micro-fluidic pump circuit has six signal lines: Clock, Fire, Reset, Data, Vaporize, and Load. In addition, power and ground connections to the resistor heaters 20 and vaporization heater 14 are provided by Hpwr and Hgnd respectively. The Reset signal is used to set the logic states of the shift registers to zero. The data signal is connected to the input shift register composed of D flip-flops. The data clocked into the shift register corresponds to the resistor heater(s) 20 that will be fired on the next fire cycle. After the data is shifted another register of latches holds the state(s) for the next pump firing cycle. When the predetermined width of the fire signal is applied to the AND gate, the resistor heaters 20 selected by the logic states of the latches are activated for the width of the fire signal. In this way, the shift register can be continuously clocked while the resistor heaters 20 are fired from the holding latches. Such logic circuits may be assembled with a pump as a separate chip or may be formed on a single chip along with a pump. A pump with integrated logic circuits on a single chip is advantageous since the pump may be fabricated with a small footprint at a low cost and be operated with minimum signal delays.

The micro-fluidic device 10 according to embodiments of the disclosure may be operated by firing resistor heaters 20 inside the channels 22 in sequence. After the last resistor heater 20 in the channel 22 is fired, the cycle repeats, starting again from the resistor heater 22 closest to the fluid inlet via 26. In principle, when a bubble grows on a resistor heater 20, the previously generated bubble needs to block the channel effectively and prevent the liquid from flowing back in the opposition direction of the resistor heater firing sequence. Two delays may be considered to optimize the performance of the pump. After one resistor heater is fired, a delay can be added before the next resistor heater is fired. It is called "fire-to-fire delay." In addition, after a cycle is completed, and the vaporization heater 14 had been activated to vaporize the fluid, a delay may be inserted before the next pumping cycle is started. This delay is called "cycle-to-cycle delay." These two delays and the width of the fire pulse may be controlled by manipulating a fire signal to the resistor heaters 20. When one resistor heater 20 is activated, the width of the fire pulse is designate tfire. On the other hand, tfire-to-fire delay is a time delay between activating two adjacent resistor heaters 20 with a firing pulse tfire. A duty cycle of the tfire-to-fire delay may range from about 50% to about 90. In other embodiments, the activation of one resistor heater 20 may be accomplished with a split firing pulse having a first pulse width sufficient to "warm up" the resistor heater and a second pulse width sufficient to actually nucleate a bubble of fluid. Other resistor heater 20 firing schemes as possible. A time delay between two firing cycles is designated tcycle-to-cycle delay.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A micro-fluidic device comprising a semiconductor silicon substrate attached to a fluid supply source and a PCB board, the semiconductor silicon substrate comprising two or more bubble pumps for flowing a predetermined amount of fluid from the fluid supply source to fluid contact with at least one vaporization heater electrically connected to the PCB board for vaporizing the fluid in contact with and pumped to the vaporization heater by the two or more bubble pumps, the vaporization heater being made of a thin film resistor material and being separate from the two or more bubble pumps on the semiconductor silicon substrate, a fluid supply inlet from the fluid supply source in fluid flow communication with each of the two or more bubble pumps, and a vapor outlet adjacent to ends of the two or more bubble pumps in vapor flow communication with the at least one vaporization heater to provide a metered quantity of vaporized fluid rather than liquid through the vapor outlet, wherein the two or more bubble pumps each have a fluid flow path selected from a linear path, a spiral path, a circuitous path, and a combination thereof from the fluid supply inlet to the at least one vaporization heater, and wherein the two or more bubble pumps comprise a plurality of resistor heaters that are electrically connected to the PCB board and are operative by voltage pulses to heat less than 0.5 μm thick layer of fluid on top of the resistor heaters to a supercritical temperature without vaporizing a bulk volume of fluid in the two or more bubble pumps.

2. The micro-fluidic device of claim 1, wherein the fluid supply source is disposed on a supply side of the semiconductor silicon substrate opposite from a first side of the semiconductor silicon substrate containing the at least one vaporization heater and the one or more bubble pumps, wherein the micro-fluidic device further comprises a fluid inlet via through the semiconductor silicon substrate from the supply side to the first side of the semiconductor silicon substrate for each of the one or more bubble pumps.

3. The micro-fluidic device of claim 1, wherein the two or more bubble pumps have fluid flow paths directed to the at least one vaporization heater.

4. The micro-fluidic device of claim 3, wherein the fluid flow paths for the two or more bubble pumps have lengths that are the same length for each fluid flow path.

5. The micro-fluidic device of claim 3, wherein each of the two or more bubble pumps provide an equal volume of liquid to the at least one vaporization heater.

6. The micro-fluidic device of claim 1, wherein a pressure provided by the two or more bubble pumps is determined by a length of the fluid flow path from the fluid supply inlet to the at least one vaporization heater.

7. The micro-fluidic device of claim 6, wherein a volume of fluid provided by the two or more bubble pumps is determined by a number of the two or more bubble pumps used in parallel.

8. A method of vaporizing two or more fluids in micro-fluidic quantities comprising the steps of:

feeding two or more fluids to a micro-fluidic device comprising a semiconductor silicon substrate attached to a fluid supply source and a PCB board, the semiconductor silicon substrate comprising two or more bubble pumps for flowing a predetermined amount of fluid from the fluid supply source to fluid contact with at least one vaporization heater electrically connected to the PCB board for vaporizing the fluid in contact with and pumped to the vaporization heater by the two or more bubble pumps, the vaporization heater being made of a thin film resistor material and being separate from the two or more bubble pumps on the semiconductor silicon substrate, a fluid supply inlet from the fluid supply source in fluid flow communication with each of the two or more bubble pumps, and a vapor outlet adjacent to ends of the two or more bubble pumps in vapor flow communication with the at least one vaporization heater to provide a metered quantity of vaporized fluid rather than liquid through the vapor outlet, wherein the two or more bubble pumps each have a fluid flow path selected from a linear path, a spiral path, a circuitous path, and a mixture thereof from the supply inlet to the at least one vaporization heater, and wherein the two or more bubble pumps comprise a plurality of resistor heaters that are electrically connected to the PCB board and are operative by voltage pulses to heat less than 0.5 μm thick layer of fluid on top of the resistor heaters to a supercritical temperature without vaporizing a bulk volume of fluid in the two or more bubble pumps, operating the two or more bubble pumps to provide the two or more fluids to the at least one vaporization heater, and vaporizing the two or more fluids with the at least one vaporization heater.

9. The method of claim 8, wherein the semiconductor silicon substrate comprises a fluid inlet via for each of the two or more bubble pumps, wherein the fluid inlet via is etched through the semiconductor silicon substrate from the fluid supply source to the two or more bubble pumps.

10. The method of claim 8, wherein the fluid supply source comprises different fluid supply sources providing different fluids for each of at least two of the two or more bubble pumps.

11. The method of claim 8, wherein the different fluids are mixed with one another at the at least one vaporization heater.

12. The method of claim 8, wherein the different fluids are reacted with one another at the at least one vaporization heater.

13. A method for reacting and vaporizing micro-fluidic quantities of two or more different fluids comprising:

providing a micro-fluidic device comprising a semiconductor silicon substrate attached to two or more fluid supply sources and a PCB board, the semiconductor silicon substrate comprising a bubble pump for each of the two or more fluid supply sources for flowing a predetermined amount of fluid from each of the two or more fluid supply sources to fluid contact with at least one vaporization heater electrically connected to the PCB board for vaporizing the fluid in contact with and pumped to the vaporization heater by each bubble pump, the vaporization heater being made of a thin film resistor material and being separate from each bubble pump on the semiconductor silicon substrate, a fluid supply inlet from each of the two or more fluid supply sources in fluid flow communication with each bubble pump, and a vapor outlet adjacent to ends of each bubble pump in vapor flow communication with the at least one vaporization heater to provide a metered quantity of vaporized fluid rather than liquid through the vapor outlet, wherein each bubble pump has a fluid flow path selected from a linear path, a spiral path, a circuitous path, and a mixture thereof from the supply inlet to the at least one vaporization heater, and wherein each bubble pump comprises a plurality of resistor heaters that are electrically connected to the PCB board and are operative by voltage pulses to heat less than 0.5 μm thick layer of fluid on top of the resistor heaters to a supercritical temperature without vaporizing a bulk volume of fluid in each bubble pump, operating each bubble pump to provide the two or more different fluids to the at least one vaporization heater, reacting the two or more different fluids on the at least one vaporization heater to provide a reaction product, and vaporizing the reaction product with the at least one vaporization heater.

14. The method of claim 13, wherein the semiconductor silicon substrate comprises a fluid inlet via for each bubble pump, wherein the fluid inlet via is etched through the semiconductor silicon substrate from the fluid supply source to each bubble pump.

15. The method of claim 13, wherein each fluid flow path for each bubble pump has a length that is the same length for each fluid flow path.

16. The method of claim 13, wherein a volume of liquid provided by each bubble pump is the same.

17. A micro-fluidic device comprising a semiconductor silicon substrate attached to a fluid supply source and a PCB board, the semiconductor silicon substrate comprising at least one bubble pump for flowing a predetermined amount of fluid from the fluid supply source to fluid contact with at least one vaporization heater electrically connected to the PCB board for vaporizing the fluid in contact with and pumped to the vaporization heater by the at least one bubble pump, the vaporization heater being made of a thin film resistor material and being separate from the at least one bubble pump on the semiconductor silicon substrate, a fluid supply inlet from the fluid supply source in fluid flow communication with the at least one bubble pump, and a vapor outlet adjacent to an end of the bubble pump in vapor flow communication with the at least one vaporization heater to provide a metered quantity of vaporized fluid rather than liquid through the vapor outlet, wherein the at least one bubble pump has a fluid flow path selected from a linear path, a spiral path, a circuitous path, and a combination thereof from the fluid supply inlet to the at least one vaporization heater, and wherein the at least one bubble pump comprise a plurality of resistor heaters that are electrically connected to the PCB board and are operative by voltage pulses to heat less than 0.5 μm thick layer of fluid on top of the resistor heaters to a supercritical temperature without vaporizing a bulk volume of fluid in the at least one bubble pump.

18. The micro-fluidic device of claim 17, wherein the fluid supply source is disposed on a supply side of the semiconductor silicon substrate opposite from a first side of the semiconductor silicon substrate containing the at least one vaporization heater and the at least one bubble pump, wherein the micro-fluidic device further comprises a fluid inlet via through the semiconductor silicon substrate from the supply side to the first side of the semiconductor silicon substrate for the at least one bubble pump.

19. The micro-fluidic device of claim 17, wherein a pressure provided by the at least one bubble pump is determined by a length of the fluid flow path from the fluid supply inlet to the at least one vaporization heater.

* * * * *